US007315141B1

(12) United States Patent
Krafft

(10) Patent No.: US 7,315,141 B1
(45) Date of Patent: Jan. 1, 2008

(54) METHOD FOR THE PRODUCTION OF WIDEBAND THZ RADIATION

(75) Inventor: Geoffrey A. Krafft, Newport News, VA (US)

(73) Assignee: Jefferson Science Associates LLC, Newport News, VA (US)

( * ) Notice: Subject to any disclaimer, the term of this patent is extended or adjusted under 35 U.S.C. 154(b) by 339 days.

(21) Appl. No.: 11/204,536

(22) Filed: Aug. 16, 2005

(51) Int. Cl.
*H01J 25/00* (2006.01)

(52) U.S. Cl. ..... 315/505; 315/5.18

(58) Field of Classification Search ..... 315/5.18, 315/5.41, 505
See application file for complete search history.

(56) References Cited

U.S. PATENT DOCUMENTS 5,714,850 A * 2/1998 Kitamura et al. ..... 315/507
6,906,478 B2 * 6/2005 Hajima et al. ..... 315/503

* cited by examiner

*Primary Examiner*—David H. Vu

(57) ABSTRACT

A method for the production of extremely wide bandwidth THz radiation comprising: delivering an electron beam from a source to an undulator that does not deflect the angle or transversely move the electron beam; and optimizing the undulator to yield peak emission in the middle of the THz band (1 THz). These objectives are accomplished by magnetically bending the orbit of the incoming electron beam in the undulator according to the function $x(z)=x_o \exp(-z^2/2\sigma^2)$ and controlling the transverse magnetic field to be $B(z)=B_0(1-z^2/\sigma^2)\exp(-z^2/2\sigma^2)$.

2 Claims, 2 Drawing Sheets

METHOD FOR THE PRODUCTION OF WIDEBAND THZ RADIATION

The United States of America may have certain rights to this invention under Management and Operating Contract No. DE-AC05-84ER 40150 from the Department of Energy.

FIELD OF THE INVENTION

The present invention relates to methods and apparatus for the generation of terahertz (THz) radiation and more particularly to a novel undulator operating method that yields extremely wide bandwidth THz radiation emerging from the undulator.

BACKGROUND OF THE INVENTION

U.S. Pat. No. 6,753,662 describes a compact THz source based upon a small linac and an undulator. Such a source can be designed to produce both narrowband and wideband THz radiation.

As described in this patent, a compact source of intense THz radiation comprising a short bunch, low energy particle beam source, an accelerator cavity and an electromagnetic wiggler or undulator. The application of state-of-the-art superconducting accelerating structures and beam recirculation allows such a THz radiation source to have a small footprint and high average intensity without the need for the large equipment necessary to produce the large charge per bunch generally associated with the production of THz radiation. Consequently, low emittance electron beams can be used to produce emitted THz radiation of high yield average brilliance.

As described in the '662 patent, the undulator utilized is of conventional design and construction and demonstrates the following properties: undulator period of 3 cm, number of oscillations up to 50 and magnetic field strength up to 1 Tesla.

While such a device/system provides entirely satisfactory THz radiation, it would be desirable to provide radiation that is of extremely wide bandwidth for better illuminating materials for analysis by THz cameras and other scanning devices.

OBJECT OF THE INVENTION

It is therefore an object of the present invention to provide a novel undulator operating methodology for use in, for example, the compact THz radiation source of U.S. Pat. No. 6,753,662 and similar devices that can generate extremely wide bandwidth THz radiation for improved illumination in THz camera and scanner applications.

SUMMARY OF THE INVENTION

According to the present invention, there is provided a method for the production of extremely wide bandwidth THz radiation comprising: delivering an electron beam from a source to an undulator that does not deflect the angle or transversely move the electron beam; and optimizing the undulator to yield peak emission in the middle of the THz band (1 THz). These objectives are accomplished by magnetically bending the orbit of the incoming electron beam in the undulator according to the function $x(z)=x_o \exp(-z^2/2\sigma^2)$ and controlling the transverse magnetic field to be $B(z)=B_0(1-z^2/\sigma^2)\exp(-z^2/2\sigma^2)$.

DESCRIPTION OF THE DRAWINGS

FIG. 2 is a graph showing the square roots of the emission spectrum as calculated for several values of the magnetic field strength parameter a.

DETAILED DESCRIPTION

U.S. Pat. No. 6,753,662 describes a compact THz source based upon a small linac and an undulator. Such a source can be designed to produce both narrowband and wideband THz radiation. The contents of U.S. Pat. No. 6,753,662 is hereby incorporated herein by reference in its entirety. The device described in this patent forms the preferred device for the successful practice of the present invention.

As described in this patent, a compact source of intense THz radiation comprising a short bunch, low energy particle beam source, an accelerator cavity and an electromagnetic wiggler or undulator. The application of state-of-the-art superconducting accelerating structures and beam recirculation allows such a THz radiation source to have a small footprint and high average intensity without the need for the large equipment necessary to produce the large charge per bunch generally associated with the production of THz radiation. Consequently, low emittance electron beams can be used to produce emitted THz radiation of high yield average brilliance. More specifically with reference to this patent, a compact THz radiation generator comprises an electron beam generator such as a thermioinic gun that generates a beam, a compact linac and an undulator and includes magnets that permit bending of the beams produced after acceleration by the linac and treatment by the undulator to permit circulation thereof through the compact system. An electron dump is provided to permit extraction of excess beam electrons. THz radiation is extracted from the compact system as the electron beam exits the undulator.

The low energy particle beam source preferably demonstrates the capability of generating a beam having an energy of about 500 KeV, a charge of between about 1 and about 10 pico coulombs and a repetition rate of about 500 to about 3000 MHz at a current of less than about 30 miliamps and an emittance of <20 mm mrad.

The electron beam emitted by the linac should exhibit an energy of from about 10 to about 20 MeV, a pulse duration of less than about 100 μm, a normalized emittance of less than about 20 mm mrad, a charge of from about 1 to about 10 pico coulombs and a repetition rate of between about 500 and about 300 MHz.

The undulator exhibits the following properties: undulator period of 3 cm, number of oscillations up to 50 and magnetic field strength up to 1 Tesla.

Figure 1:
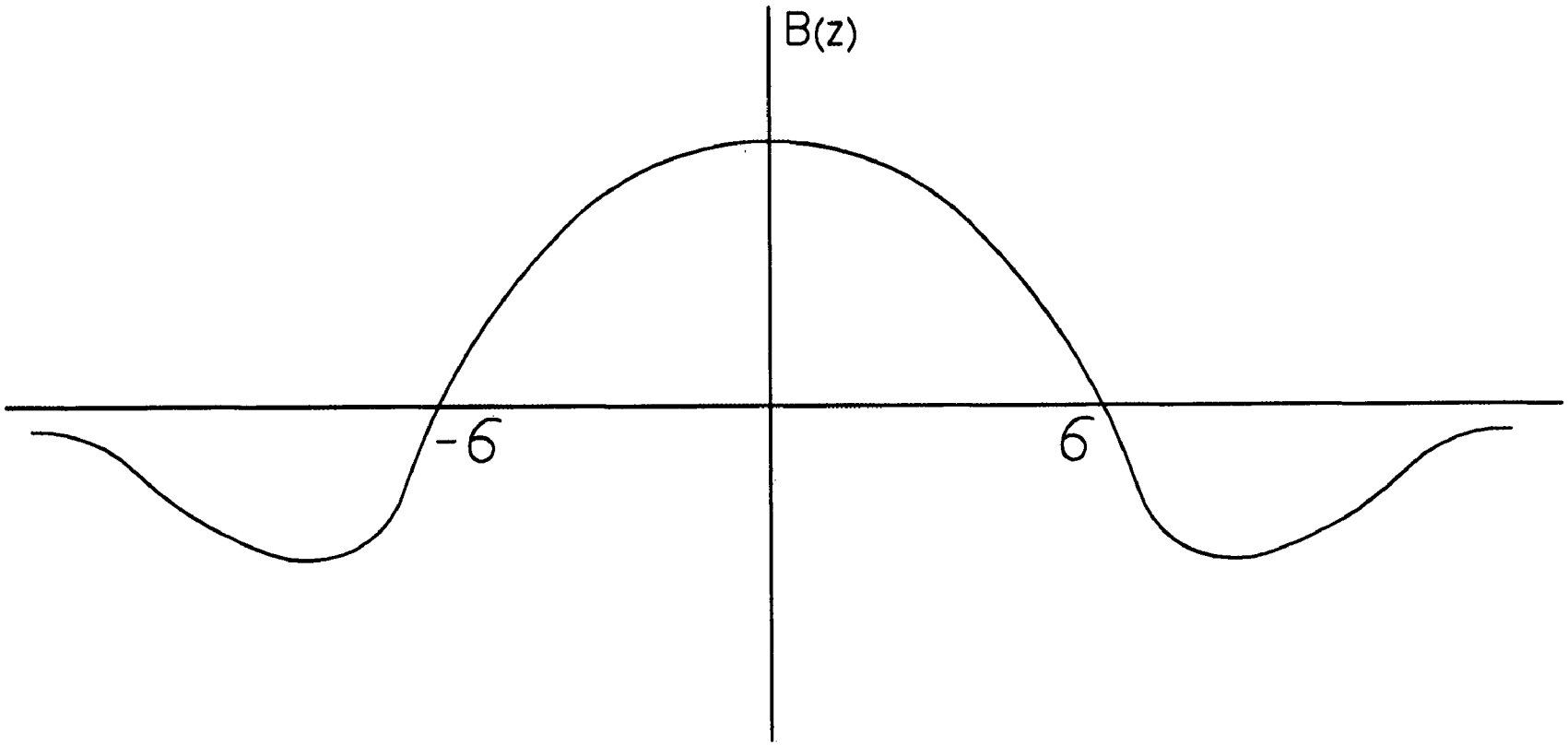
FIG. 1 is a graph showing the magnetic field of the undulator in accordance with the design specifications described herein.
Figure 2:
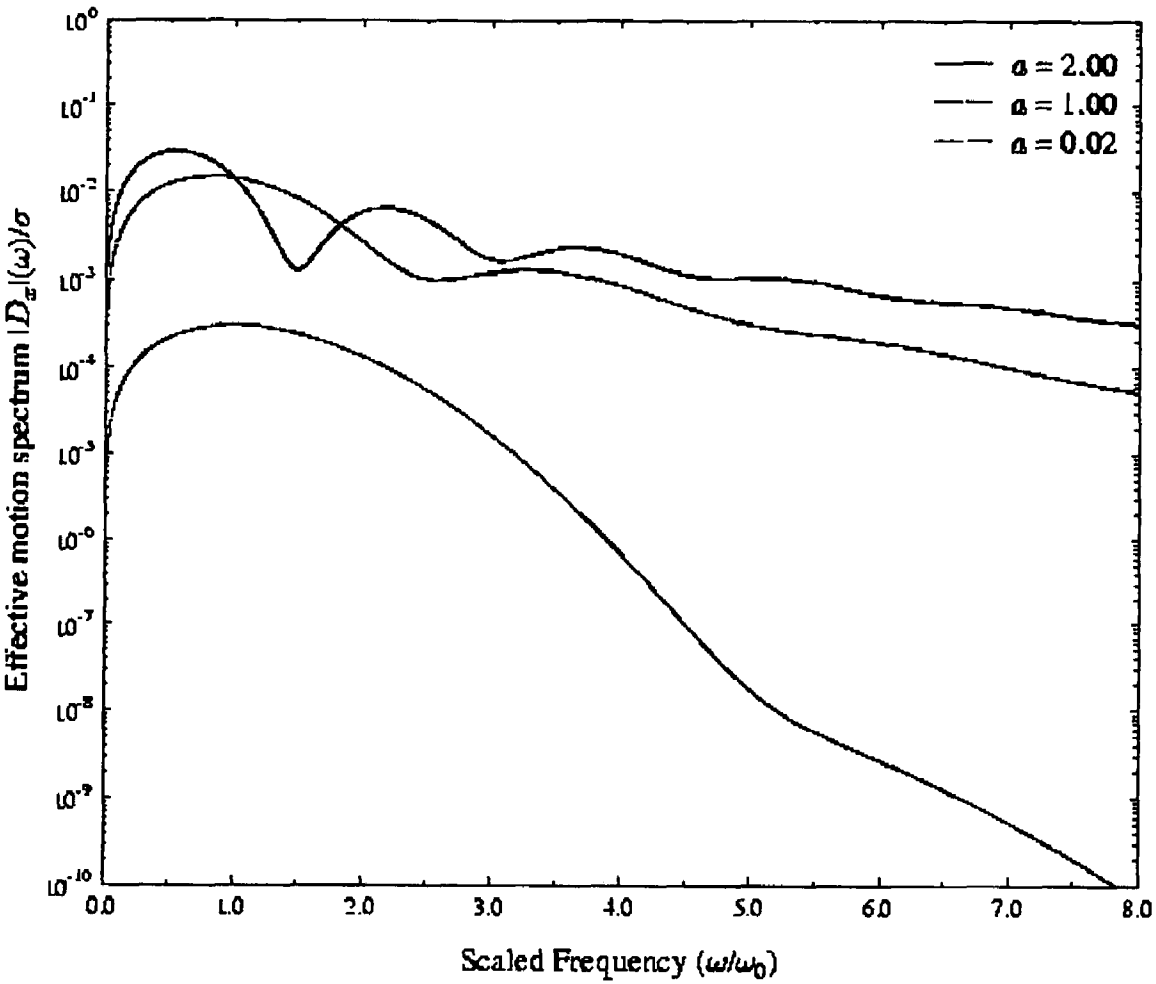

According to the present invention, there is provided method for the production of extremely wide bandwidth THZ radiation by a method that comprises delivering an electron beam from a source to an undulator that does not deflect the angle or transversely move the electron beam; and optimizing the undulator to yield peak emission in the middle of the THz band (1 THz). These results are achieved by magnetically bending the orbit of the incoming electron beam in the undulator according to the function $x(z)=x_o \exp(-z^2/2\sigma^2)$ and controlling the transverse magnetic field to be $B(z)=B_0(1-z^2/\sigma^2)\exp(-z^2/2\sigma^2)$ as in FIG. 1 where $x_0$ is the peak deflection by the undulator and $B_0$ is the maximum value of the magnetic field. The square root of the emission spectrum is calculated as shown in FIG. 2 at several values of magnetic field strength a. By proper selection of $\sigma$ and the beam energy, the maximum of the emission peak can be tuned to a proper/desired value.

At low field strengths, the radiation spectrum emitted under such undulator operating conditions follows a classical curve, with full width half-maximum spectral widths of from about 0.62 and 1.44 times the frequency of the peak of the emitted spectrum. At higher field strengths, the spectrum red shifts slightly and widens still further up to a limit set by destructive interference between the emission from various parts of the undulator orbit.

As seen in the accompanying Figures, D is the effective motion spectrum or Fourier spectrum of the magnetic field and includes elements like radiation red shifting and retardation that results when the field strength gets large. It is somewhat easier to discuss changes in the magnetic spectrum using this quantity $(D(\omega)/\sigma)$ in lieu of the spectrum itself. To obtain the actual spectrum of radiation emitted from the undulator take this quantity, square it and multiply by the frequency squared. The quantity $a=eB_o\sigma/mc^2$ characterizes the magnetic field strength and increases for stronger magnetic fields. The curve is scaled to the frequency with maximum $D(\omega_0=2\gamma^2c/\sigma)$ and this quantity depends on the beam energy and the size of the undulator, a being the variable describing the size of the undulator. For the THz applications and the beam energy sources discussed in the '662 patent discussed above, this value is about 4 cm. These equations are convenient functional forms for deeming the undulator deflection and field patterns and are well known in the art. The peak magnetic field parameter $B_0$ has a value of several Tesla for those cases useful in the device described in the '662 patent.

Finally, in order to obtain a wide band undulator as described herein, the magnetic field should be designed as shown in attached FIG. 1 and described hereinabove. When this design is followed, the resulting motion spectrum is as shown in attached FIG. 2.

As the invention has been described, it will be apparent to those skilled in the art that the same may be varied in many ways without departing from the spirit and scope of the invention. Any and all such modifications are intended to be included within the scope of the appended claims.

What is claimed is:

1. A method for the production of extremely wide bandwidth THz radiation comprising: delivering an electron beam from a source to an undulator that does not deflect the angle or transversely move the electron beam; and optimizing the undulator to yield peak emission in the middle of the THz band (1 THz) by magnetically bending the orbit of the incoming electron beam in the undulator according to the function $x(z)=x_o \exp(-z^2/2\sigma^2)$ and controlling the transverse magnetic field to be $B(z)=B_0(1-z^2/\sigma^2)\exp(-z^2/2\sigma^2)$.

2. A method for the operation of a compact apparatus for the production of intense THz radiation which apparatus comprises:

a) a particle beam source that generates a short bunch particle beam having an energy between about 100 and about 500 KeV, a charge of between about 1 and about 10 pico coulombs, a repetition rate of from about 500 to about 3000 MHz at a current of less than about 30 milliamps and an emittance of <20 mm mrad;

b) a linac comprising one or more series of compact superconducting cavities that are capable of delivering up to 10 million volts that accelerates said beam as it is received from said particle source;

c) an undulator that receives said beam from said linac and generates THz radiation; and d) a magnet that bends said particle beam as it exits said undulator thereby permitting extraction of THz radiation therefrom;

said method comprising:

i) delivering an electron beam to said undulator that is designed to not deflect the beam in angle or transversely; and ii) optimizing the undulator to yield peak emission in the middle of the THz band (1 THz) by magnetically bending the orbit of the incoming electron beam in the undulator according to the function $x(z)=x_o \exp(-z^2/2\sigma^2)$ and controlling the transverse magnetic field to be $B(z)=B_0(1-z^2/\sigma^2)\exp(-z^2/2\sigma^2)$.

* * * * *